US010739007B2

(12) United States Patent
Cires et al.

(10) Patent No.: US 10,739,007 B2
(45) Date of Patent: Aug. 11, 2020

(54) FLAMESHEET DIFFUSION CARTRIDGE

(71) Applicant: Power Systems Mfg., LLC, Jupiter, FL (US)

(72) Inventors: Alfredo Cires, Jupiter, FL (US); Peter Stuttaford, Jupiter, FL (US); Matthew Yaquinto, Jupiter, FL (US); Hany Rizkalla, Jupiter, FL (US); Khalid Oumejjoud, Jupiter, FL (US); Fred Hernandez, Jupiter, FL (US); Bryan Kalb, Jupiter, FL (US); Nicolas Demougeot, Jupiter, FL (US); Joshua R McNally, Jupiter, FL (US); Ramesh Keshava Bhattu, Jupiter, FL (US); Bernard Tam-Yen Sam, Jupiter, FL (US)

(73) Assignee: POWER SYSTEMS MFG., LLC, Jupiter, FL (US)

( * ) Notice: Subject to any disclaimer, the term of this patent is extended or adjusted under 35 U.S.C. 154(b) by 129 days.

(21) Appl. No.: 15/974,870

(22) Filed: May 9, 2018

(65) Prior Publication Data

US 2019/0346142 A1 Nov. 14, 2019

(51) Int. Cl.
*F23R 3/34* (2006.01)
*F23R 3/60* (2006.01)

(52) U.S. Cl.
CPC ..... *F23R 3/343* (2013.01); *F23R 3/60* (2013.01); *F05D 2270/08* (2013.01); *F23C 2900/07001* (2013.01); *F23D 2211/00* (2013.01)

(58) Field of Classification Search
CPC ..... F23R 3/343; F23R 3/60; F23D 2211/00
See application file for complete search history.

(56) References Cited

U.S. PATENT DOCUMENTS 4,955,191 A * 9/1990 Okamoto ..... F02C 3/30 60/39.3
5,836,164 A * 11/1998 Tsukahara ..... F23C 6/047 60/733
5,901,555 A * 5/1999 Mandai ..... F23D 23/00 60/39.826
6,176,087 B1 * 1/2001 Snyder ..... F23C 7/002 239/403
6,178,752 B1 * 1/2001 Morford ..... F23C 7/002 239/403
2004/0129001 A1 * 7/2004 Lehtinen ..... F23D 11/107 60/740

(Continued)

*Primary Examiner* — Ted Kim
(74) *Attorney, Agent, or Firm* — Hovey Williams LLP

(57) ABSTRACT

A diffusion cartridge assembly for a gas turbine engine, and methods of using the same. The diffusion cartridge assembly includes a tip plate with an array of fuel supply openings and a mounting hole radially inward of the array of fuel supply openings, an end cover, and an outer sleeve extending from the tip plate to the end cover and defining an open inner chamber. A fuel supply line is coupled to the end cover and extends within the open inner chamber toward the tip plate. A manifold is coupled to an end of the fuel supply line proximate to the tip plate, and includes an array of fuel injector tips. Each of the fuel injector tips extends through a respective one of the array of fuel supply openings in the tip plate. The manifold also includes a thermally free mounting pin extending into the mounting hole.

11 Claims, 11 Drawing Sheets

(56) References Cited

U.S. PATENT DOCUMENTS

| | | | | |
|---|---|---|---|---|
| 2006/0168966 | A1* | 8/2006 | Stuttaford | F02C 7/22 60/772 |
| 2014/0116054 | A1* | 5/2014 | Means | F23R 3/283 60/739 |
| 2015/0184858 | A1* | 7/2015 | Stuttaford | F02C 9/26 60/776 |
| 2016/0084169 | A1* | 3/2016 | Stuttaford | F02C 7/228 60/776 |
| 2017/0002742 | A1 | 1/2017 | Jorgensen et al. | |
| 2017/0003032 | A1* | 1/2017 | Jorgensen | F23R 3/002 |
| 2018/0356098 | A1* | 12/2018 | Johnson | F23R 3/50 |

* cited by examiner

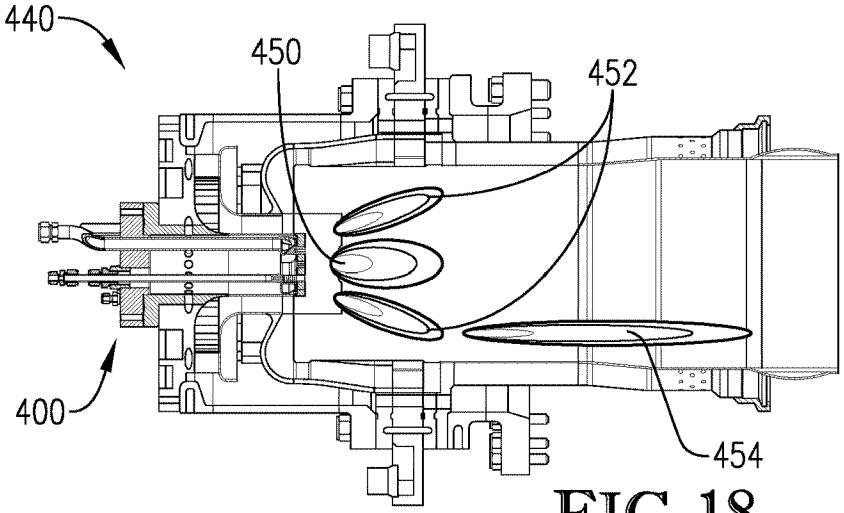
FIG. 17
FIG. 18
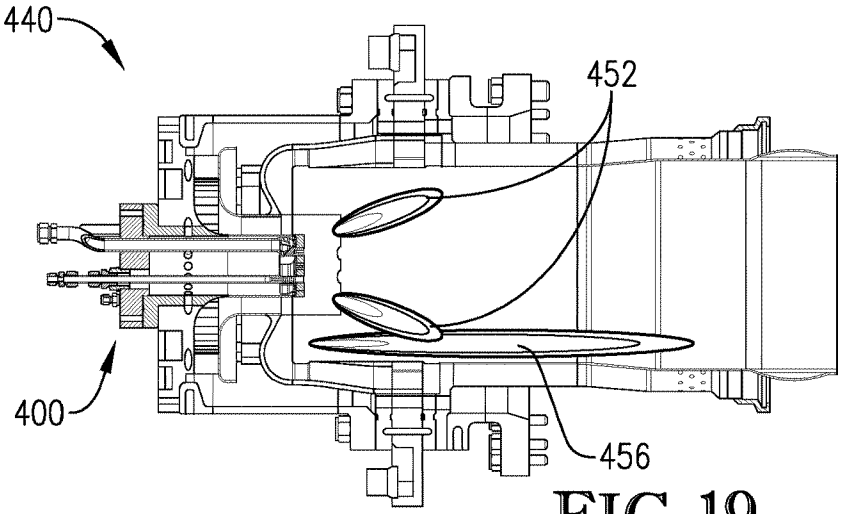
FIG. 19
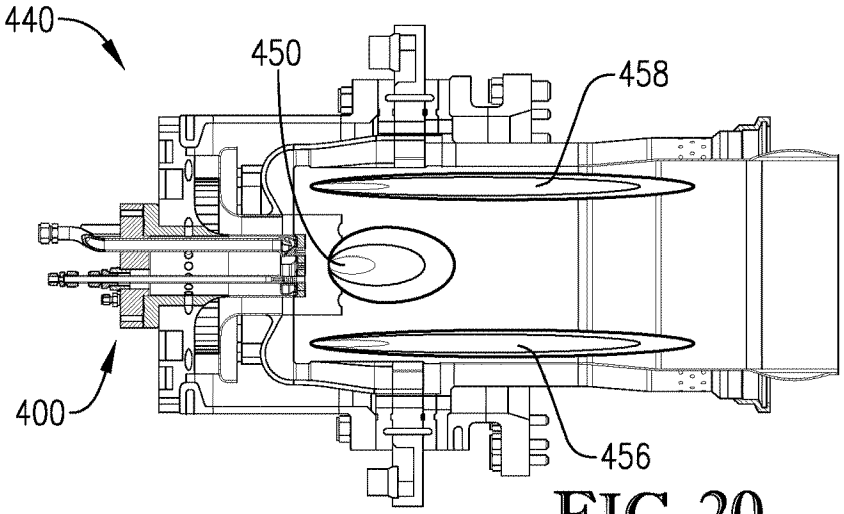
FIG. 20

FLAMESHEET DIFFUSION CARTRIDGE

TECHNICAL FIELD

The present invention generally relates to combustion systems and methods for operating the same that reduce emissions in a gas turbine combustor. More specifically, the present invention is directed to a diffusion cartridge for a gas turbine combustor that reduces CO emissions during periods of turndown, and methods of operating the same.

BACKGROUND OF THE INVENTION

In an effort to reduce the amount of pollution emissions from gas-powered turbines, governmental agencies have enacted numerous regulations requiring reductions in the amount of oxides of nitrogen (NOx) and carbon monoxide (CO). Lower combustion emissions can often be attributed to a more efficient combustion process, with specific regard to fuel injector location and mixing effectiveness.

Early combustion systems utilized only diffusion type nozzles, where fuel is mixed with air external to the fuel nozzle by diffusion, proximate the flame zone. Combustors using only diffusion type nozzles produced high emissions because the fuel and air burn stoichiometrically at high temperature to maintain adequate combustor stability and low combustion dynamics.

An enhancement in combustion technology is the utilization of premixing, where the fuel and air mix prior to combustion to form a homogeneous mixture that burns at a lower temperature than a diffusion type flame and produces lower NOx emissions. Premixing can occur either internal to the fuel nozzle or external thereto, as long as it is upstream of the combustion zone. Premixing fuel and air together before combustion allows for the fuel and air to form a more homogeneous mixture, which will burn more completely, resulting in lower emissions.

Although premixing may be effective at high loads and turbine speeds, premixing can have certain drawbacks at low loads and/or low speeds. More particularly, gas turbine engines are required to operate at a variety of power settings and speeds. Where a gas turbine engine is coupled to drive a generator, required output of the engine is often measured according to the amount of load on the generator, or power that must be produced by the generator. A full load condition is the point where maximum output is drawn from the generator and therefore requires a maximum power from the engine to drive the generator. This is the most common operating point for land-based gas turbines used for generating electricity.

However, often electricity demands do not require the full capacity of the generator, and the operator desires for the engine to operate at a lower load setting, such that only the load demanded is being produced, thereby saving fuel and lowering operating costs. Combustion systems of the prior art have been known to become unstable at lower load settings, especially below 50% load, while also producing unacceptable levels of NOx and CO emissions. This condition is especially prevalent during startup prior to achieving a minimum turndown load. This is primarily due to the fact that most combustion systems are staged for most efficient operation at high load settings. The combination of potentially unstable combustion and higher emissions often times prevents engine operators from running engines at lower load settings, forcing the engines to either run at higher settings, thereby burning additional fuel, shutting down, or producing extraordinarily high emissions levels during the startup procedure thereby losing valuable revenue that could be generated from the part-load demand in compliance with emissions regulations.

A problem with shutting down the engine is the additional cycles incurred by the engine hardware. A cycle is commonly defined as the engine passing through the normal operating envelope. That is, by shutting down an engine, the engine hardware accumulates additional cycles. Engine manufacturers typically rate hardware life in terms of operating hours or equivalent operating cycles. Therefore, incurring additional cycles can reduce hardware life and require premature repair or replacement at the engine operator's expense.

What is needed is a system that can provide flame stability and low emissions benefits at a part load condition, as well as at a full load condition, such that an engine can be efficiently operated at lower load conditions, thereby eliminating the wasted fuel when high load operation is not demanded or incurring the additional cycles on the engine hardware when shutting down.

SUMMARY

Embodiments of the present invention are directed to a diffusion cartridge assembly for a gas turbine engine and combustion systems employing the same. Other embodiments of the present invention are directed to methods of operating such combustion systems.

More particularly, some aspects of the present invention are directed to a diffusion cartridge assembly for a gas turbine engine combustion system that includes a tip plate including an array of fuel supply openings and a mounting hole radially inward of the array of fuel supply openings. The diffusion cartridge assembly also includes an end cover and an outer cylindrical sleeve extending from the tip plate to the end cover and defining an open inner chamber. A fuel supply line is coupled to the end cover and extends within the open inner chamber toward tip plate. The diffusion cartridge assembly also includes a manifold coupled to an end of the fuel supply line proximate to the tip plate, which includes an array of fuel injector tips. Each of the fuel injector tips extends through a respective one of the array of fuel supply openings in the tip plate. The manifold may also include a thermally free pin extending into the mounting hole of the tip plate.

Other aspects are directed to a combustion system including a similar diffusion cartridge assembly. In addition to the diffusion cartridge assembly, the combustion system includes a cylindrical combustion liner having an inlet, an outlet, and a center axis and defining a combustion chamber. A main mixer is located radially outward of the cylindrical combustion liner relative to the center axis and is configured to premix fuel and compressed air upstream of the combustion chamber forming a premixed fuel and air mixture. The main mixer directs the premixed fuel and air mixture towards one or more main flames within the combustion chamber, which are located circumferentially about the periphery of the combustion chamber. The diffusion cartridge assembly extends about the center axis of the cylindrical combustion liner, radially inward of the one or more main flames. In such embodiments, the diffusion cartridge assembly is configured to inject a gaseous fuel directly into the combustion chamber proximate the inlet of the cylindrical combustion liner.

Other aspects of the present invention are directed to a method for operating a similar combustion system of a gas turbine engine. The method includes providing a cylindrical combustion liner defining a combustion chamber, the cylindrical combustion liner having an inlet, an outlet, and a center axis, and also providing a main mixer located radially outward of the cylindrical combustion liner relative to the center axis. A main premixed fuel and air mixture, which is formed by premixing fuel and compressed air upstream of the combustion chamber at the main mixer, is directed into the combustion chamber such that it supports one or more main combustion flames within the combustion chamber, the one or more main combustion flames being located circumferentially about the periphery of the combustion chamber. The method further includes providing a diffusion cartridge assembly radially inward of the one or more main combustion flames, the diffusion cartridge assembly extending about the center axis of the cylindrical combustion liner and into the combustion chamber, and injecting gaseous fuel directly into the combustion chamber using the diffusion cartridge assembly. The gaseous fuel is injected into the combustion chamber proximate the inlet of the cylindrical combustion liner and at an oblique angle with respect to the center axis.

Additional advantages and features of the present invention will be set forth in part in a description which follows, and in part will become apparent to those skilled in the art upon examination of the following or may be learned from practice of the invention.

BRIEF DESCRIPTION OF THE DRAWINGS

The present invention is described in detail below with reference to the attached drawing figures, in which like numerals represent the same components, and wherein:

FIG. 2 is an end view of the gas turbine engine combustion system shown in

FIG. 1;

FIG. 4 is a left-rear perspective view of the diffusion cartridge assembly shown in

FIG. 3;

FIG. 5 is a cross-section view of the diffusion cartridge assembly shown in

FIG. 3;

FIG. 16 is a close-up sectional view of the diffusion cartridge assembly shown in

FIG. 3;

FIG. 17 is a cross-section view of a combustor employing the diffusion cartridge assembly shown in FIG. 3, when operated in a first mode of operation;

FIG. 18 is another cross-section view of the combustor employing the diffusion cartridge assembly shown in FIG. 3, when operated in a second mode of operation;

FIG. 19 is another cross-section view of the combustor employing the diffusion cartridge assembly shown in FIG. 3, when operated in a third mode of operation; and FIG. 20 is another cross-section view of a combustor employing the diffusion cartridge assembly shown in FIG. 3, when operated in a fourth mode of operation.

DETAILED DESCRIPTION

Figure 1:
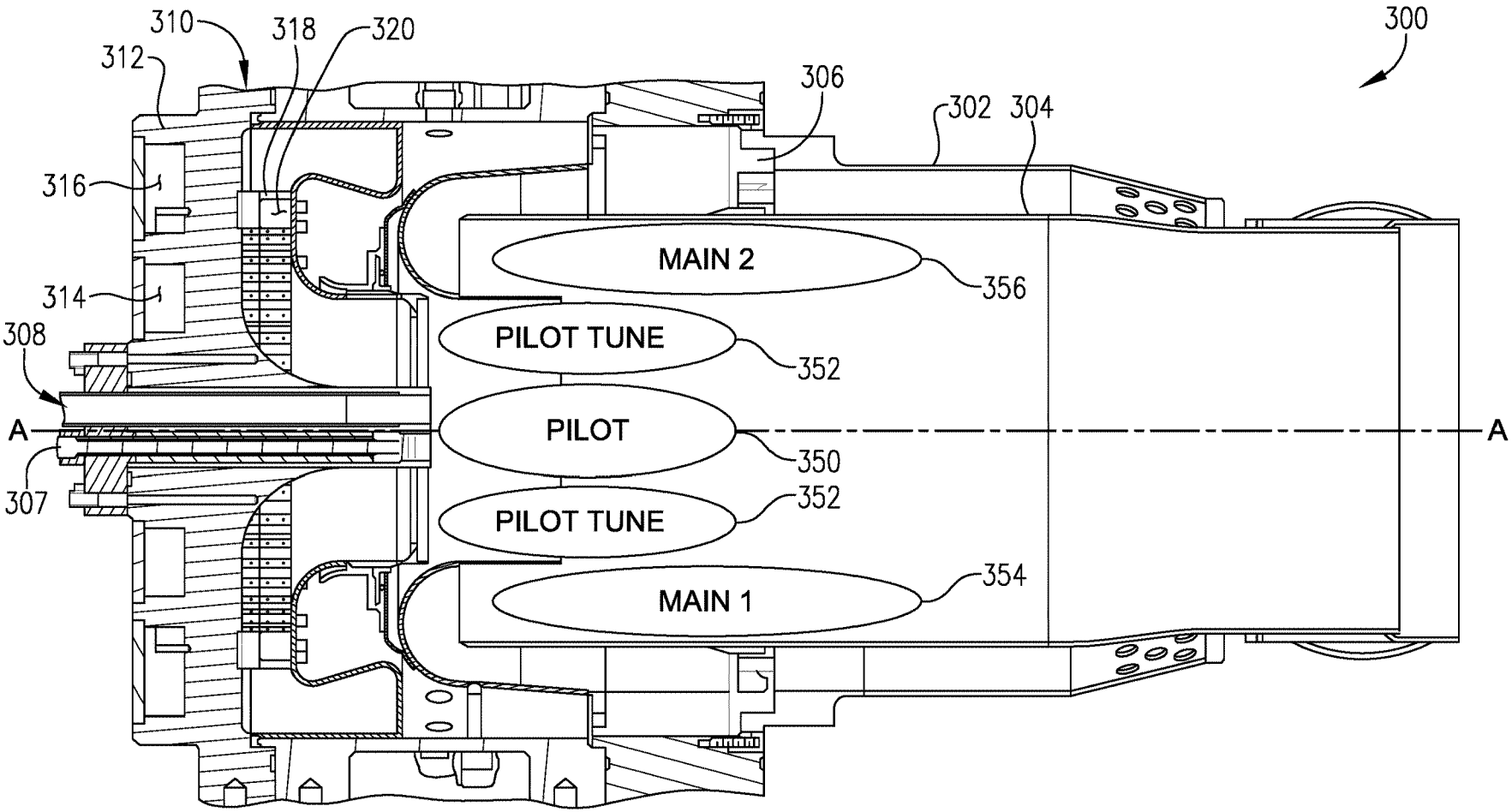
FIG. 1 is a cross-section view of a gas turbine engine combustion system.

Embodiments of the instant invention will be described in detail with reference to the accompanying figures. Aspects of the disclosure relate to a fuel cartridge for a gas turbine engine combustor, which, in some embodiments, can be employed in combustion systems such as the combustion system 300 shown in FIG. 1. The combustion system 300 extends about a longitudinal axis A-A and includes a flow sleeve 302 for directing a predetermined amount of compressor air along an outer surface of a combustion liner 304. Main fuel injectors 306 are positioned radially outward of the combustion liner 304 and are designed to provide a fuel supply to mix with compressed air along a portion of the outer surface of the combustion liner 304, prior to entering the combustion liner 304. The fuel injected by the main fuel injectors 306 mixes with compressed air and travels in a forward direction towards the inlet region of the combustion liner 304, where the fuel/air mixture then reverses direction and enters the combustion liner 304. Extending generally along the longitudinal axis A-A is a pilot fuel nozzle 308 for providing and maintaining a pilot flame for the combustion system. The pilot flame is used to ignite, support and maintain multiple stages of fuel injectors of combustion system 300.

The combustion system 300 also includes a radially staged premixer 310. The premixer 310 comprises an end cover 312 having a first fuel plenum 314 extending about the longitudinal axis A-A of the combustion system 300 and a second fuel plenum 316 positioned radially outward of the first fuel plenum 314 and concentric with the first fuel plenum 314. The radially staged premixer 310 also comprises a radial inflow swirler 318 having a plurality of vanes 320 oriented in a direction that is at least partially perpendicular to the longitudinal axis A-A of the combustion system 300.

The pilot fuel nozzle 308 is connected to a fuel supply (not shown) and provides fuel to the combustion system 300 for supplying a pilot flame 350 where the pilot flame 350 is positioned generally along the longitudinal axis A-A. The radially staged premixer 310 including the fuel plenums 314 and 316, radial inflow swirler 318 and its plurality of vanes 320 provide a fuel-air mixture through the vanes 320 for supplying additional fuel to the pilot flame 350 by way of a pilot tune stage, or P-tune, 352. The pilot tune stage 352 may include a set of pilot tune stage injectors. In some applications to achieve desired turbine performance, the pilot fuel nozzle 308 and pilot tune stage 352 may be combined and set to a predefined or actively adjusted fuel flow split. The combustion system 300 includes a spark igniter or torch 307 to initially light the combustion system 300. The torch 307 may also be utilized to supplement the pilot flame 350 and/or pilot tune flame 352 during mode transfer to further stabilize such flame about the central flame axis.

As discussed above, combustion system 300 also includes main fuel injectors 306. For the embodiment of the present invention shown in FIG. 1, the main fuel injectors 306 are located radially outward of the combustion liner 304 and spread in an annular array about the combustion liner 304. The main fuel injectors 306 may comprise one or more portions and stages extending equally or unequally about a circumference of the main fuel stage. The main fuel injectors 306 may include a main set of fuel injectors having a first portion and a second portion. As an example of an application for the described invention, the main fuel injectors may be divided into two stages, the first portion and the second portion. The two portions form a circle around the primary fuel nozzle (as shown in FIG. 2) and the first portion extends approximately 120 degrees, while the second portion extends the remaining, approximately 240 degree span. The first portion of the main fuel injectors 306 generate a Main 1 flame 354 while the second portion of the main fuel injectors 306 generate a Main 2 flame 356.

Figure 2:
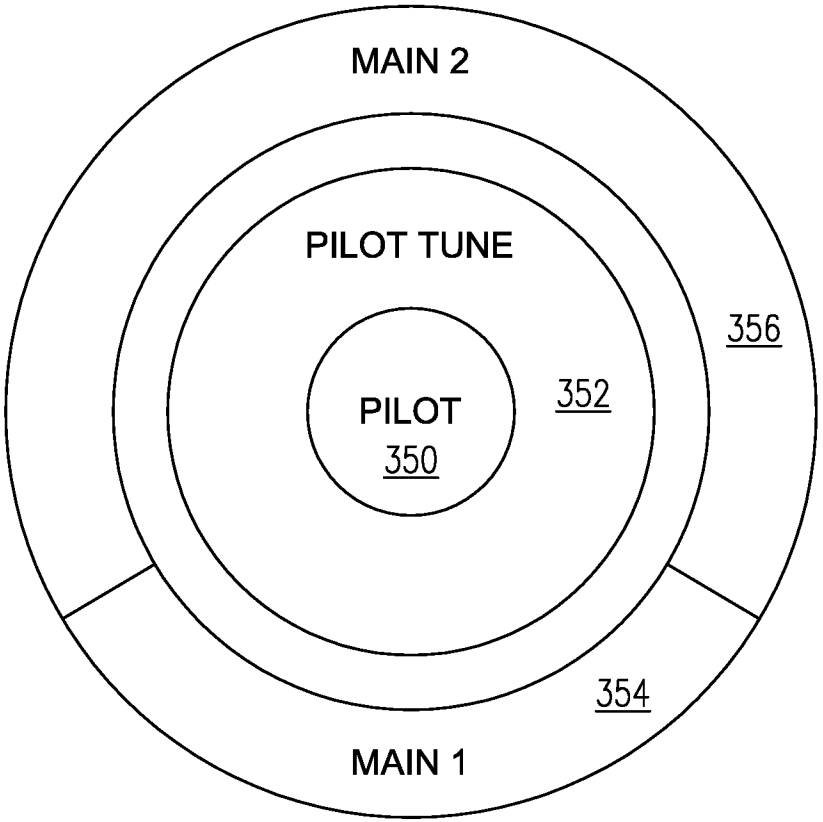

Referring to FIG. 2, an aft view, looking forward into the gas turbine combustor of FIG. 1 is depicted. FIG. 2 displays the radial and circumferential location of each of the flame locations within combustion system 300, with pilot flame 350 at the center, pilot tune stage 352 located radially outward of the pilot flame 350 and Main 1 flame 354 and Main 2 flame 356 located radially outward of the pilot tune stage 352. That is, the Main 1 flame 354 and the Main 2 flame 356 form a circle located circumferentially about the periphery of the combustion chamber.

A gas turbine engine incorporates a plurality of combustors. Generally, for the purpose of discussion, the gas turbine engine may include low emission combustors such as those disclosed herein and may be arranged in a can-annular configuration about the gas turbine engine. One type of gas turbine engine (e.g., heavy duty gas turbine engines) may be typically provided with, but not limited to, 6 to 18 individual combustors, each of the combustors fitted with the components outlined above. Accordingly, based on the type of gas turbine engine, there may be several different fuel circuits utilized for operating the gas turbine engine. It is envisioned that the specific fuel circuitry and associated control mechanisms could be modified to include fewer or additional fuel circuits.

Figure 3:
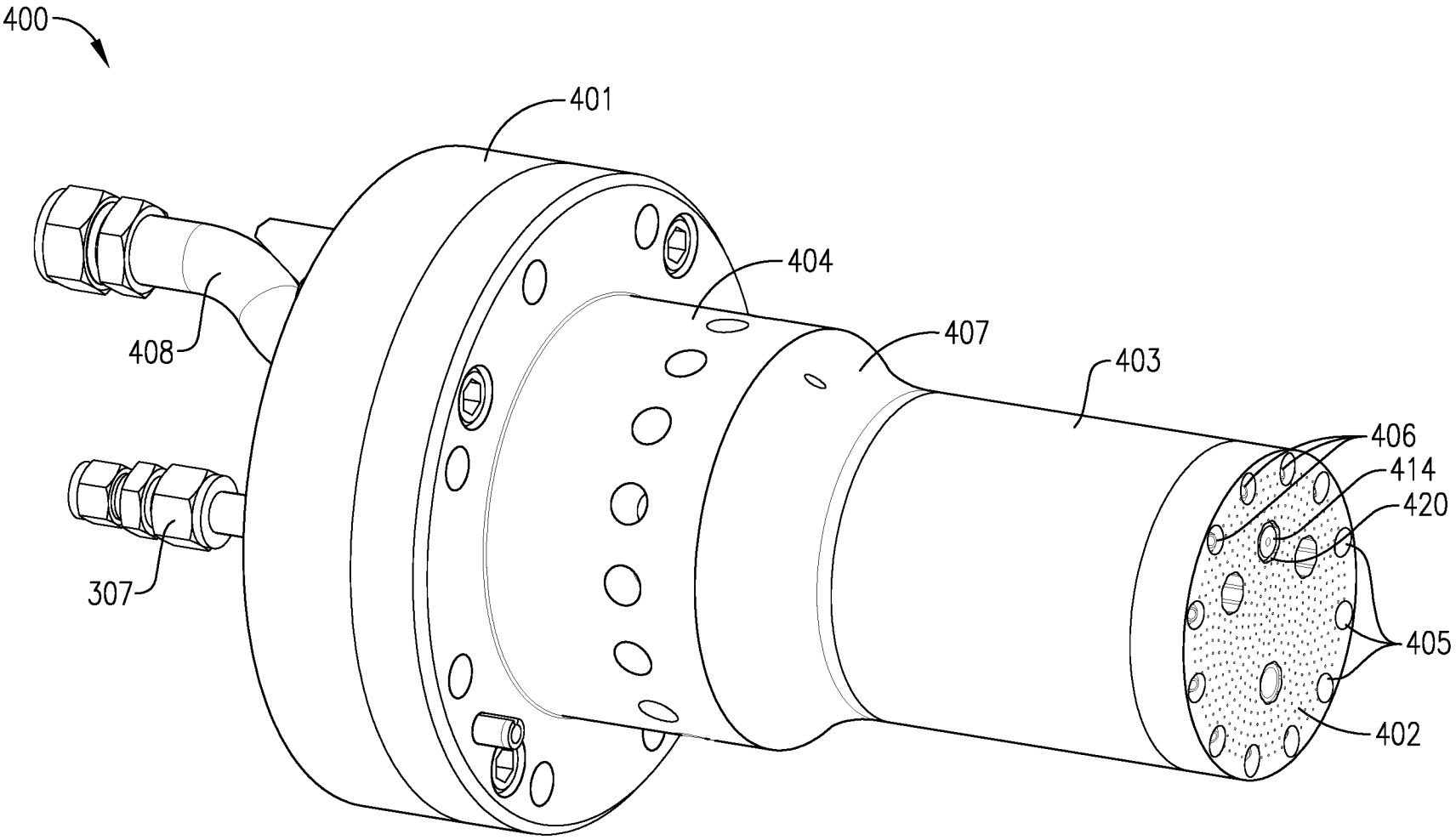
FIG. 3 is a left-front perspective view of a diffusion cartridge assembly for use in a gas turbine combustion system, according to an embodiment of the invention.
Figure 4:
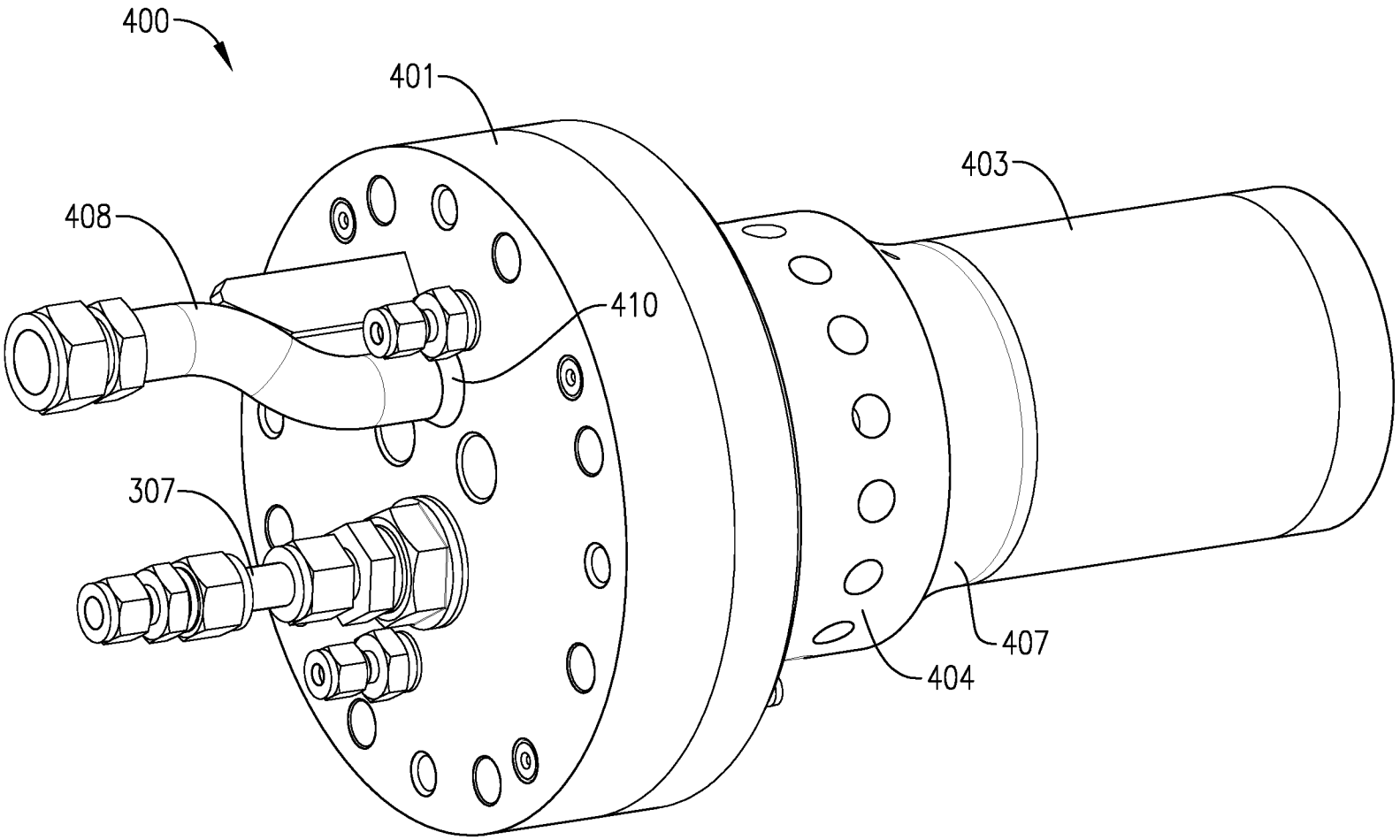

Turning now to FIGS. 3-4, a diffusion cartridge assembly 400 according to aspects of the present invention is shown. The diffusion cartridge assembly 400 may be used with a gas turbine combustor, such as the combustion system 300 shown in FIG. 1. More particularly, accordingly to some aspects of the invention, the pilot fuel nozzle 308 in combustion system 300 may be replaced with diffusion cartridge assembly 400. In other embodiments, the gaseous fuel injection features of the diffusion cartridge assembly 400 discussed below can be implemented in the pilot fuel nozzle 308 such that the modified nozzle can support both a premixed pilot flame and a gaseous fuel diffusion flame.

Moreover, in some embodiments the diffusion cartridge assembly 400 may be utilized in known commercially available gas turbine combustors, such as a FlameSheet® combustor commercially available from Power Systems Manufacturing, LLC, Jupiter, Fla. Details related to the FlameSheet® combustor may found in, among other documents, U.S. Pat. No. 6,935,116, entitled "FlameSheet Combustor;" U.S. Pat. No. 6,986,254, entitled "Method of Operating a FlameSheet Combustor;" U.S. Patent Application Publication No. 20140090390, entitled "FlameSheet Combustor Dome," U.S. Patent Application Publication No. 20150075172, entitled "FlameSheet Combustor Contoured Liner," U.S. Patent Application Publication No. 20140090396, entitled "Combustor with Radially Staged Premixed Pilot," U.S. Patent Application Publication No. 20140090389, entitled "Variable Length Combustor Dome Extension for Improved Operability," and U.S. Patent Application Publication No. 2017/0002742, entitled "Fuel Injection Locations Based on Combustor Flow Path." Each of these referenced applications, publications, and patents are incorporated herein by reference in their entirety.

The diffusion cartridge assembly 400 includes an end cover 401, a tip plate 402, and an outer sleeve 403, 404, 407 extending from the tip plate 402 towards the end cover 401 and defining an open inner chamber 418. The outer sleeve includes a first outer sleeve portion 403 extending from the tip plate 402 towards the end cover 401, and a second outer sleeve portion 404 extending from the end cover 401 towards the tip plate 402. The second outer sleeve portion 404 extends radially outward from the first outer sleeve portion 403, and is coupled to the first outer sleeve portion 403 via a smooth transition portion 407.

The tip plate 402 includes a circular array of fuel injector openings 405 near an outer circumferential edge of the tip plate 402, each of which receives a respective fuel injector tip 406. A mounting hole 420 is provided radially inward of the array of fuel injector openings 405, and is configured to receive and support a fuel manifold 412, which will be discussed in detail below. In some embodiments, the tip plate 402 may also include other openings to accommodate one or more spark igniters (not shown), the torch 307, and/or the pilot fuel circuit.

In some embodiments, the diffusion cartridge assembly 400 is configured to supply gaseous fuel to an interior of a combustor. Thus, the diffusion cartridge assembly 400 also includes a fuel supply line 408 such as a natural gas supply line. In some embodiments, the fuel supply line 408 may extend through the end cover 401 and be fixedly coupled thereto. For example, in some embodiments the fuel supply line 408 may be affixed to the end cover 401 at supply line weld 410. In other embodiments, the fuel supply line 408 may be secured to the end cover 401 using a threaded fastener, additively manufactured as a single unit, or the like. Moreover, although the fuel supply line 408 and manifold 412 is discussed in connection with a gaseous fuel (e.g., natural gas), in other embodiments the diffusion cartridge assembly 400 (including the fuel supply line 408, manifold 412, fuel injector tips 406, and other components) may be used to provide a liquid fuel, fuel/water mixture, or any other desired fuel directly into the combustion chamber without departing from the scope of this invention. In such embodiments, the fuel supply line 408 is configured to accommodate the liquid fuel or the like.

As best seen in FIGS. 5-11, the fuel supply line 408 extends axially through the open inner chamber 418 of the diffusion cartridge assembly, and terminates at a fuel manifold 412 located proximate the tip plate 402. The fuel supply line 408 is joined via threading, welding, or any other suitable means to the manifold 412 at the joint 424, or, in some embodiments, may be additively manufactured as a single unit with the manifold 412. The fuel supply line 408 and manifold 412 are hollow, such that gaseous fuel supplied to the fuel supply line 408 will travel through the line 408, into the manifold 412—more particularly, a generally annular fuel chamber 428 provided therein—and exit the manifold via the fuel injector tips 406.

The manifold 412 includes an internal fuel deflector 422 located proximate the joint 424. As best seen in FIGS. 10-11 and 14-15, the deflector 422 may be provided at an oblique angle with respect to an outer, cylindrical wall of the manifold 412 so as to disrupt the flow path of gaseous fuel moving through the fuel supply line 408 and manifold 412. More particularly, gaseous fuel flowing through the fuel supply line 408 will encounter the deflector 422 and disperse about the annular fuel chamber 428, such that gaseous fuel is evenly provided to each respective fuel injector tip 406.

Figure 8:
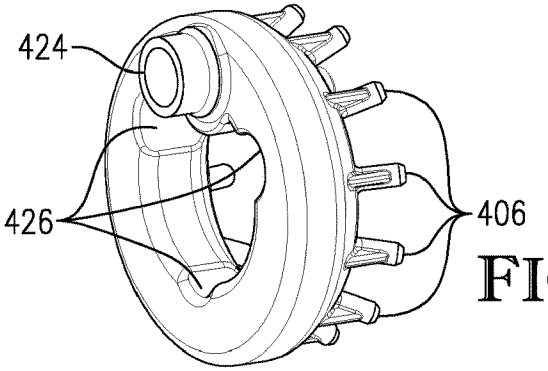
FIG. 8 is a rear perspective view of the manifold shown in FIG. 7.
Figure 7:
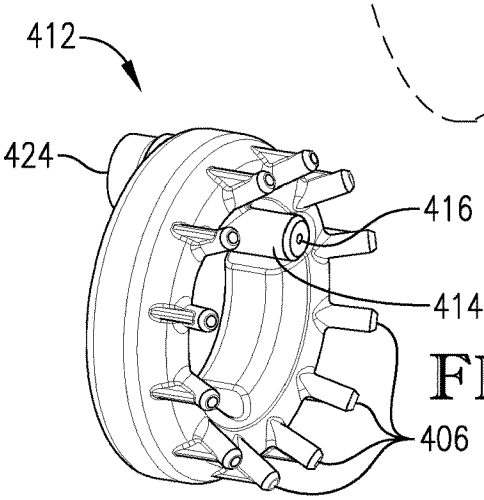
FIG. 7 is a right-front perspective view of the manifold used in the diffusion cartridge assembly shown in FIG. 3.
Figure 9:
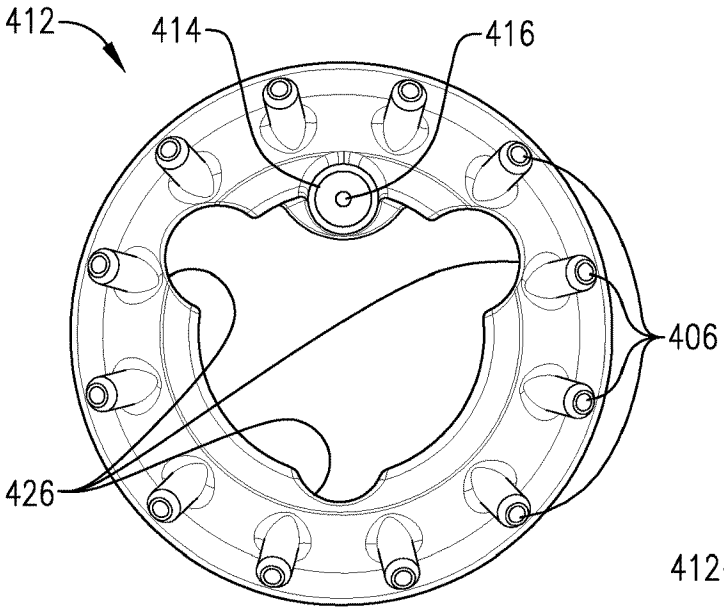
FIG. 9 is a front view of the manifold shown in FIG. 7.
Figure 13:
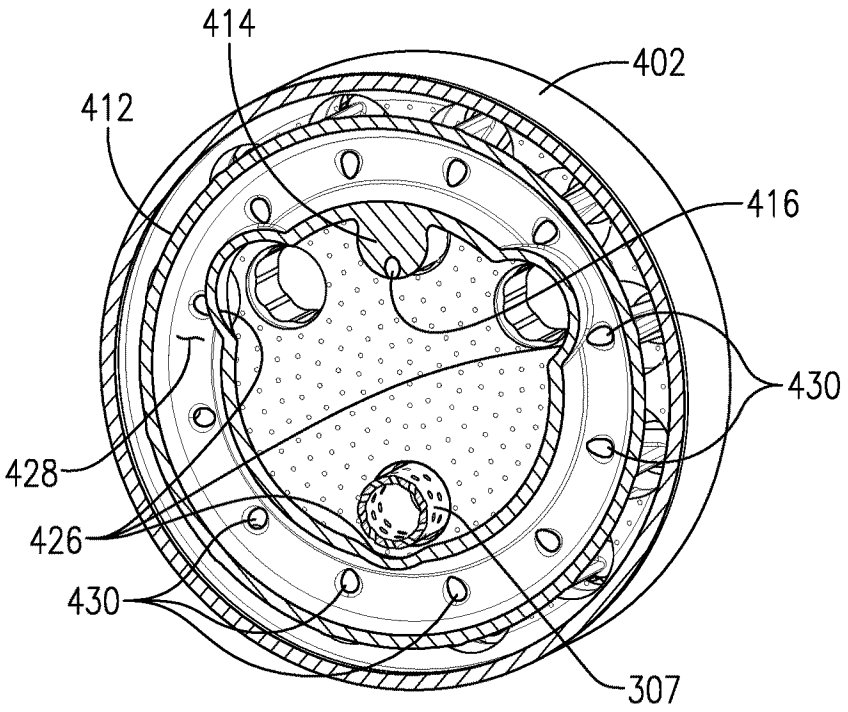
FIG. 13 is a rear perspective view of the cross-section shown in FIG. 12.
Figure 12:
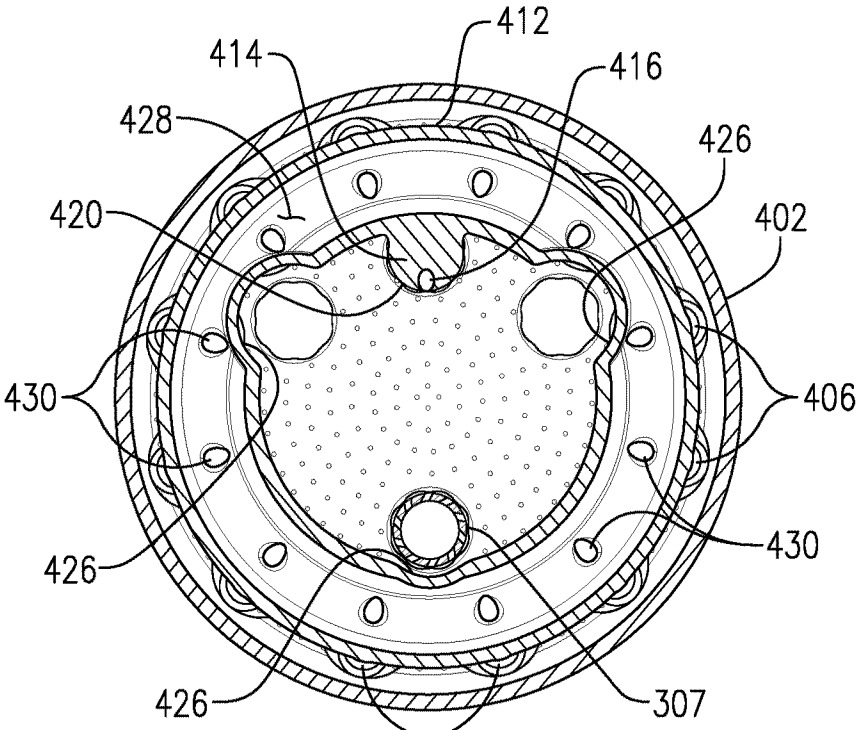
FIG. 12 is a cross-section view of the diffusion cartridge assembly shown in FIG. 3, near a tip plate thereof.
Figure 14:
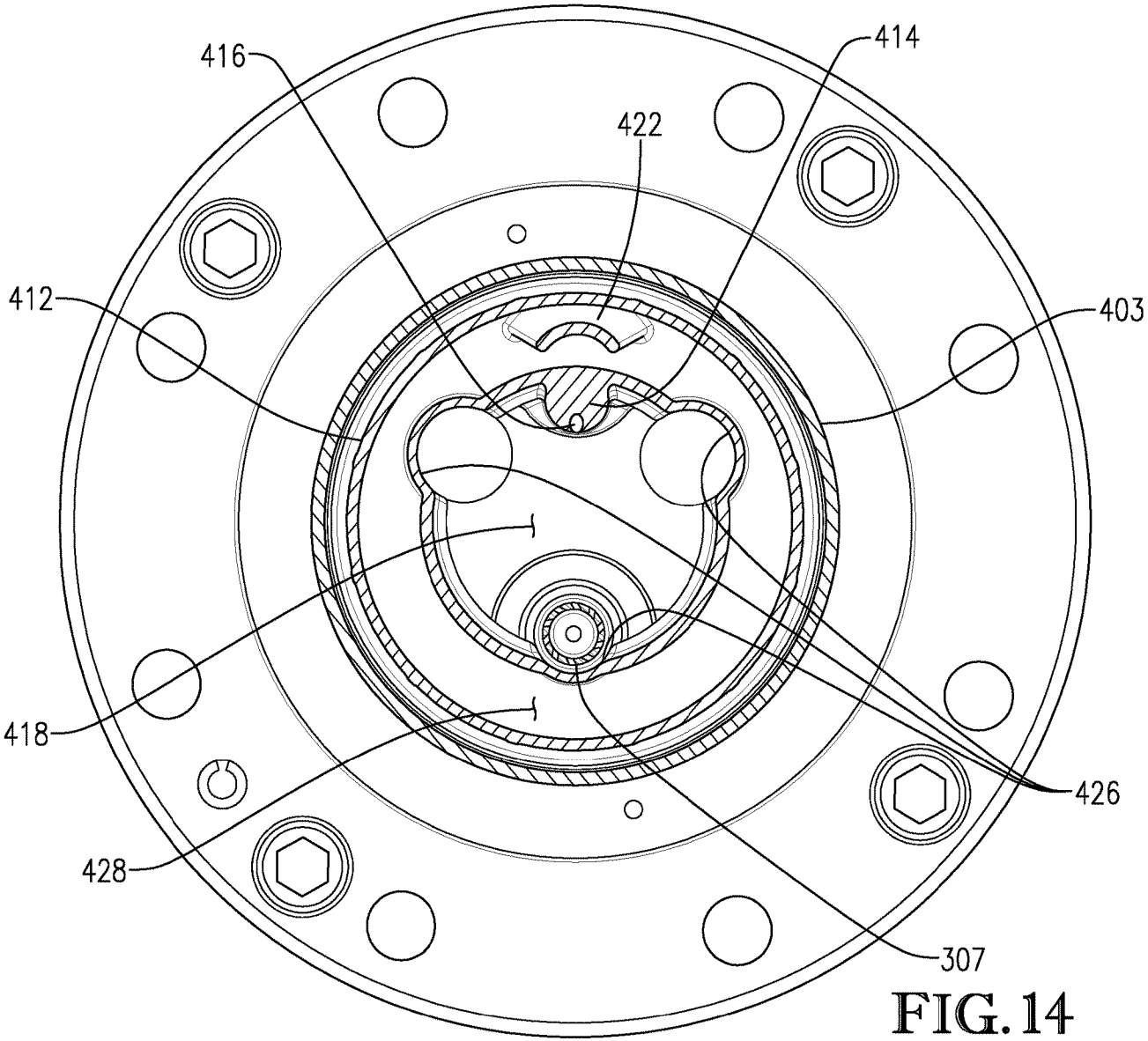
FIG. 14 is another cross-section view of the diffusion cartridge assembly shown in FIG. 3, near a tip plate thereof.

As best seen in FIGS. 7-9, the manifold may include cutouts 426 accommodating spark igniters (not shown), the torch 307, and/or the pilot fuel circuit (not shown). For example, as seen in FIGS. 3-4, in some embodiments the tip plate 402 may include three openings to receive the spark igniters, the torch 307, and/or the pilot fuel circuit. In such embodiments, the manifold 412 similarly includes three cutouts 426 so that the spark igniters, the torch 307, and/or pilot fuel injectors can axially extend through an open center portion of the manifold 312 without interference by the manifold 412.

The manifold 412 also includes a thermally free pin 414 used to non-fixedly support the manifold 412 within the diffusion cartridge assembly 400, and more particularly, within a mounting hole 420 of the tip plate 402. "Thermally free" in this context is used to mean that the pin 414 is non-fixedly supported within the mounting hole 420 to reduce thermally induced stresses that may otherwise occur in the vicinity of the tip plate 402 stemming from unequal expansion of the manifold 412 and tip plate 402 due to the changing temperatures associated with lighting, extinguishing of the various combustion flames, and relative geometrical location within the combustion chamber. In the depicted embodiment, the pin 414 is generally cylindrical, and is received in the corresponding mounting hole 420, a inner surface of which supports the weight of the manifold 412 and part of the weight of the fuel supply line 408. In some embodiment, mounting hole 420 may utilize an irregularly shaped opening, such as that seen in FIG. 16, in order to provide additional cooling to pin 414. This additional cooling acts to both provide fluid communication from the combustion chamber to the inner chamber 418 of the diffusion cartridge assembly 400, therefore purging the air therein, and to prevent thermal mismatch between the areas adjacent the pin connection to the manifold and pin tip proximate the hot combustion chamber region. However, in other embodiments the pin 414 and/or mounting hole 420 may by any other shape without departing from the scope of this disclosure.

Figure 5:
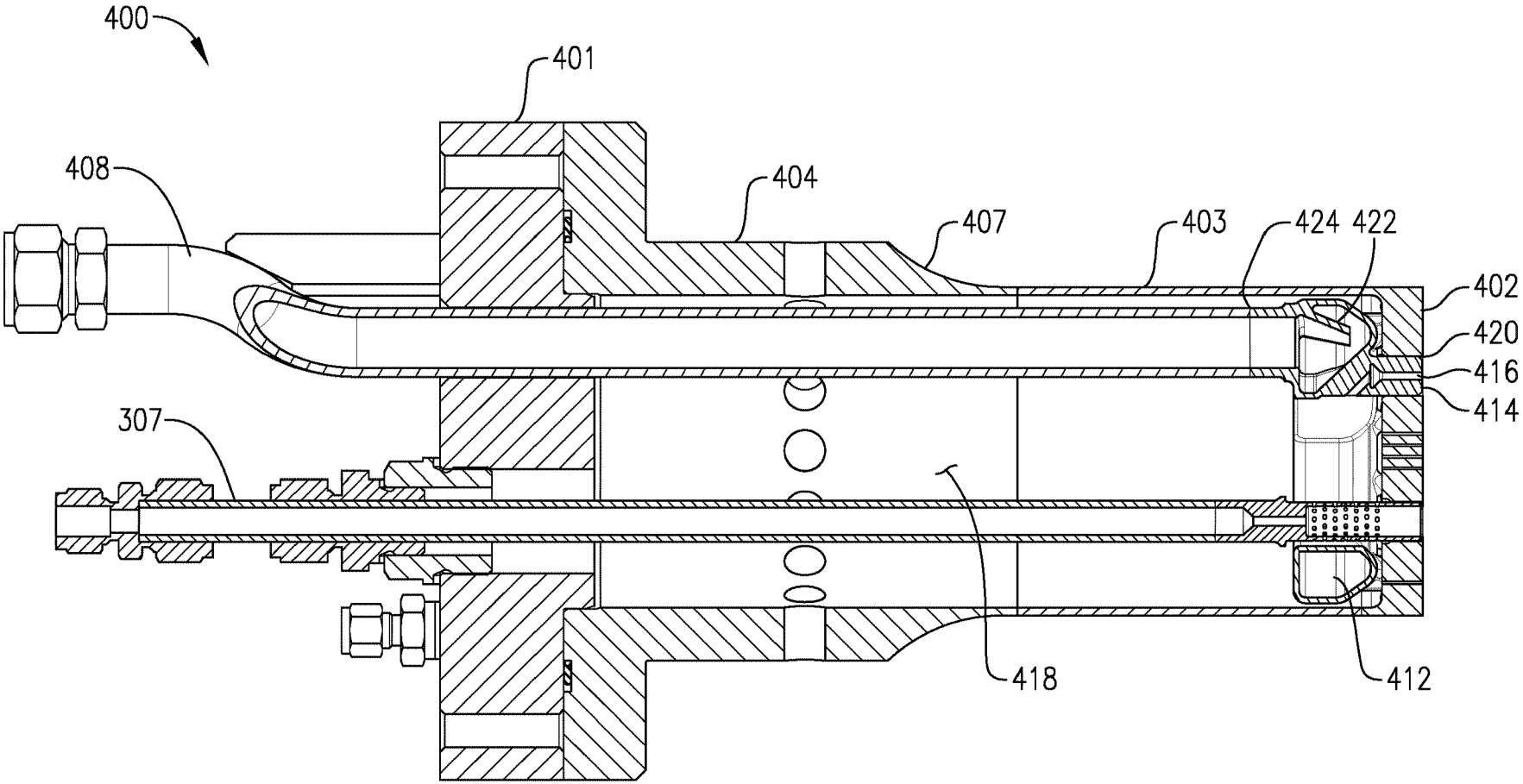
Figure 6:
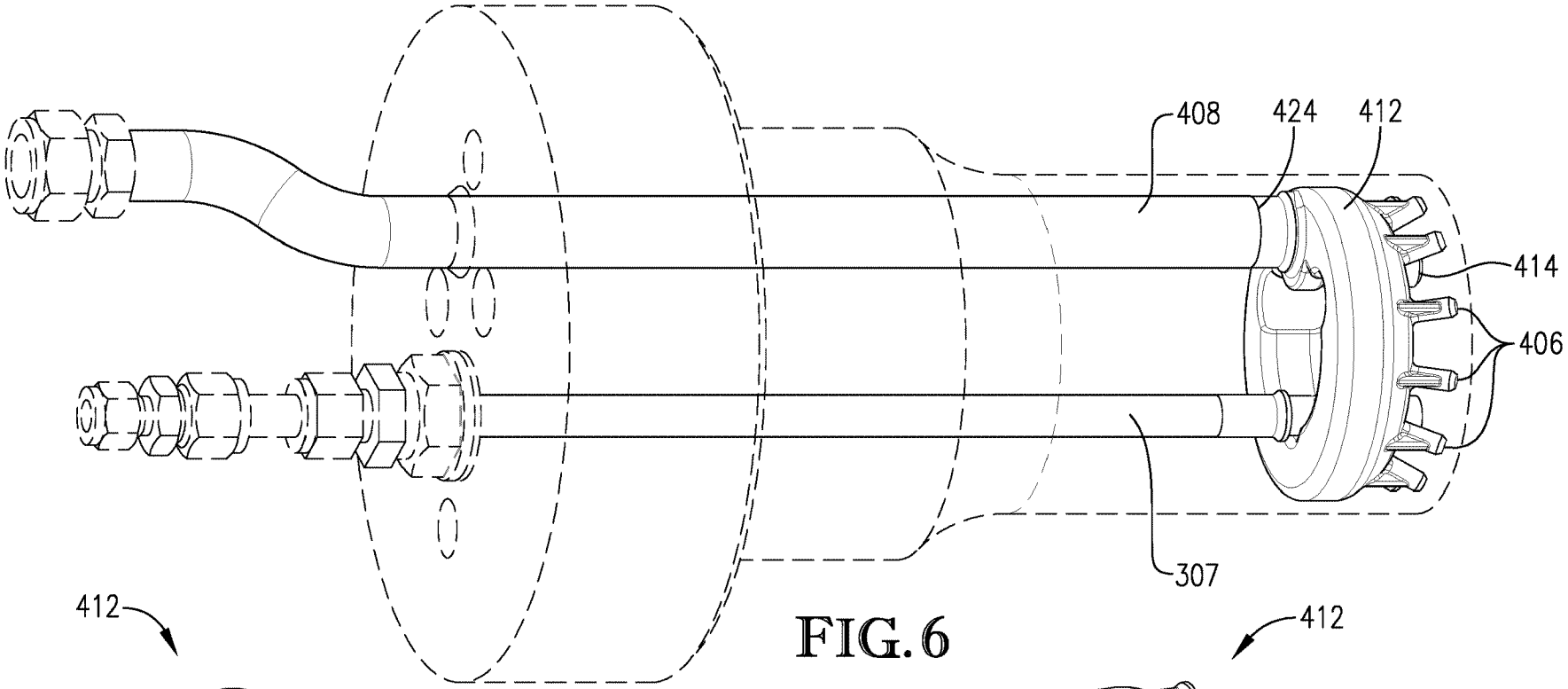
FIG. 6 is a left-rear perspective view of a fuel supply line and manifold assembly used in the diffusion cartridge assembly shown in FIG. 3.
Figure 16:
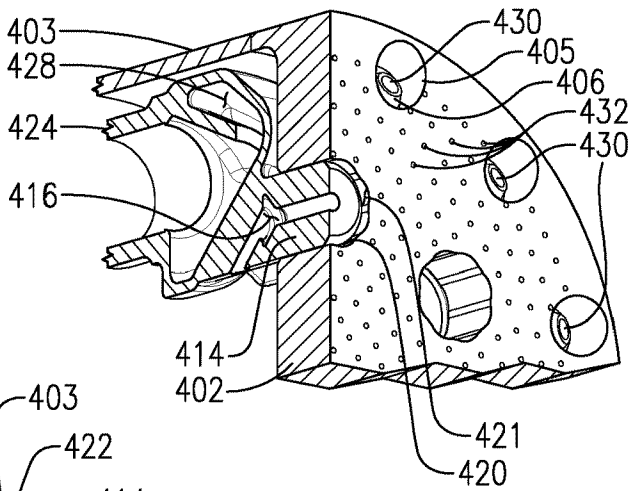
Figure 15:
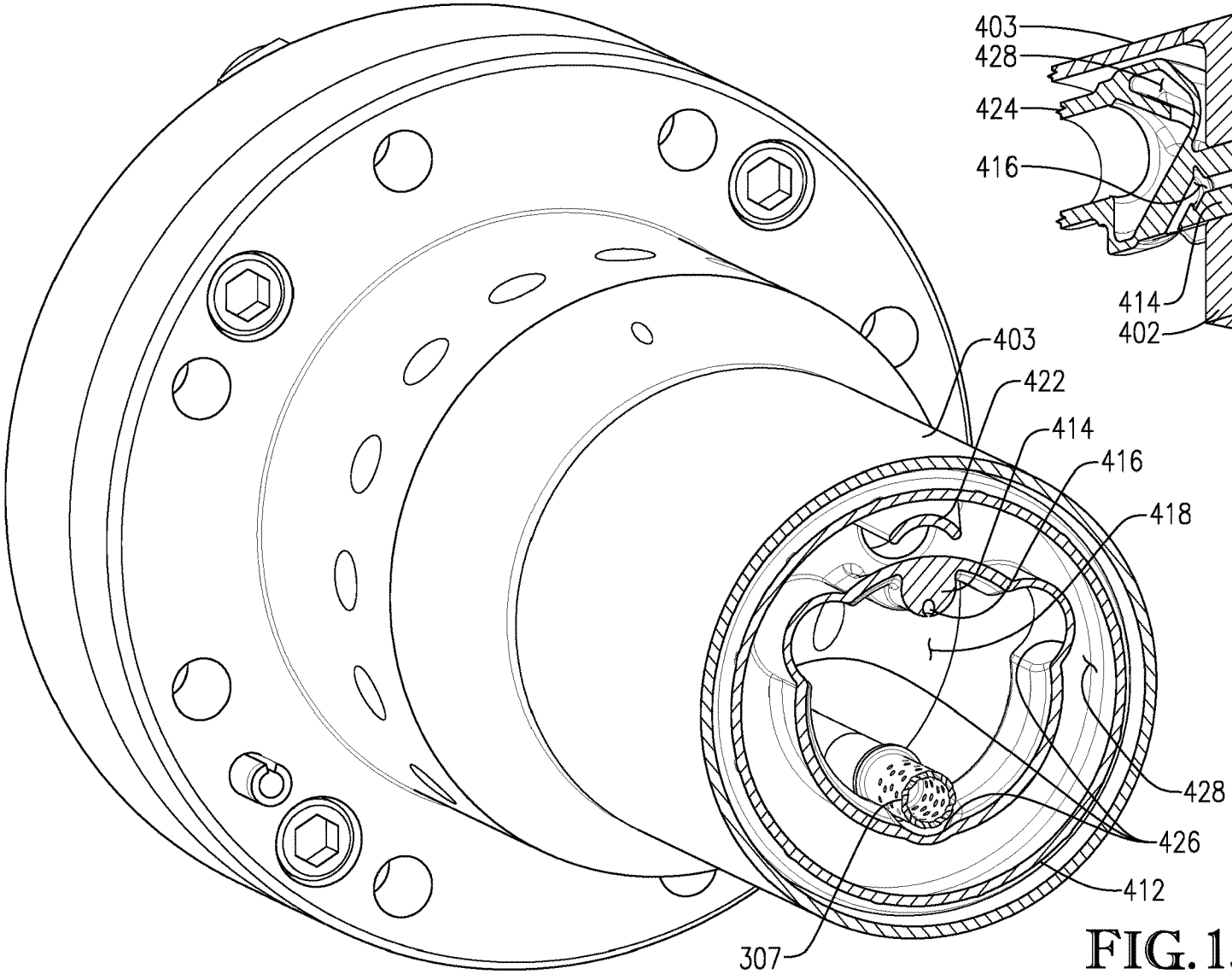
FIG. 15 is a front perspective view of the cross-section shown in FIG. 14.

In some embodiments, the pin 414 is freely received within the mounting hole 420 without it being permanently affixed thereto. In such embodiments, the manifold 412 can move and/or expand or contract independent of the tip plate 402 during use of the combustion system 300 with maximum movement restricted by the pin 414 such that interference between the manifold 412 and diffusion cartridge assembly 400 inner walls and/or fuel injectors to tip plate 402 is physically constrained. Moreover, and as best seen in FIGS. 5 and 16, a diameter of the mounting hole 420 is larger than a diameter of the pin 414, forming thermal expansion spacing 421. In this regard, the pin 414 and manifold 412 are able to freely expand and contract in response to changes in operating temperatures proximate to the tip plate 402. More particularly, thermal expansion spacing 421 is formed between the larger diameter mounting hole 420 and smaller diameter pin 414, such that during use—that is, when the diffusion cartridge assembly 400 is supporting a diffusion flame, discussed more fully below—the pin and manifold may expand as the flame zone heats, and contract as the flame zone cools.

In some embodiments, the fuel supply line 408 is a rigid, non-flexible feed tube, such as a tube made of rigid steel or similar construction. Because this non-flexible feed tube 408 is affixed to the end cover 401 at weld 410 or the like, and because the manifold 412 (and more particularly the pin 414) is not permanently fixed at the forwardmost end thereof, the tube 408 and manifold 412 assembly (best seen in FIGS. 5-6) forms a lever about the weld 410 and/or end cover 401, with the weld 410 and/or end cover 401 acting as a fulcrum. This in turn reduces thermal stress proximate the tip plate 402 as temperatures vary with the various flames ignited and extinguished nearby. More particularly, the fulcrum-type assembly of the tube 408 and manifold 412 assembly allows free movement of the forward manifold 412 while adequately absorbing vibratory stresses during operation of the combustor. Moreover, placing a gaseous fuel manifold 412 near the tip plate 402 introduces a cold body (i.e., gaseous fuel-laden manifold 412) near a hot environment (i.e., the tip plate 402 and proximate combustion chamber). This could otherwise result in unacceptable levels of thermal stresses, which are reduced or even eliminated by using this rigid, non-flexible feed tube 408 in association with the thermally free pin 414 and corresponding mounting hole 420.

Moreover, because in some embodiments the pin 414 is not welded, threaded, or otherwise affixed to the tip plate 402, there is no weld or other joint subject to the changing temperatures that otherwise could fail in the face of the changing environment and associated stresses produced thereby. Instead, the fuel supply line 408 and manifold 412 assembly is only fixed to the end cover 401 via supply line weld 410 or similar joint. This weld 410 or similar is sufficiently removed from the combustion chamber such that it is not subject to dramatic temperature changes and thus is less prone to failure. Moreover, because supply line weld 410 or similar is provided on an outer surface of the end cover 401—that is, a surface of the end cover 401 facing away from the inner chamber 418—the weld 410 or similar is even further isolated from the hot combustion chamber than if the weld 410 or similar were on an inner surface of the end cover 401—i.e., a surface of the end cover 401 facing the inner chamber 418.

Figure 10:
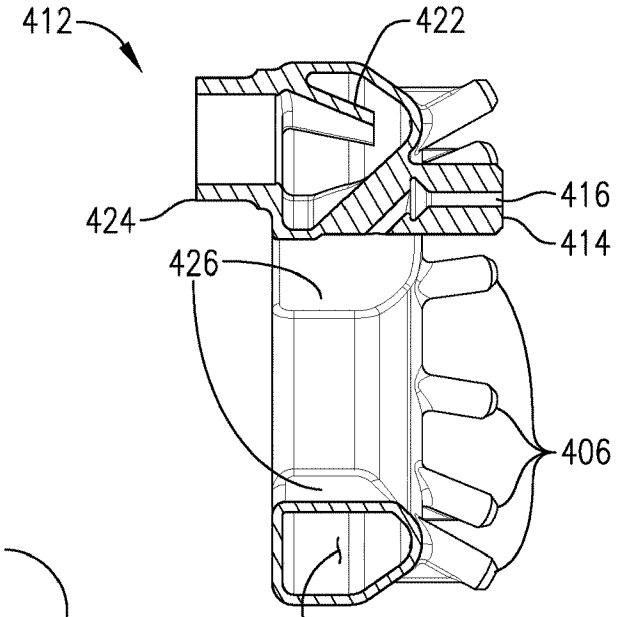
FIG. 10 is a cross-section view of the manifold shown in FIG. 7.

The pin 414 may also include one or more purge holes 416. The purge hole 416, best seen in FIGS. 5, 10, and 16, is a through hole extending from a front face of the pin 414 and extending to an inner wall of the annular manifold 412. The purge hole provides fluid communication from the combustion chamber to the inner chamber 418 of the diffusion cartridge assembly 400, therefore purging the air therein while providing cooling to the pin 414 to prevent a thermal mismatch between the area adjacent pin connection to the manifold and pin tip area proximate the hot combustion chamber region. In some embodiments, the tip plate 402 may also include a plurality of purge holes 432, as best seen in FIG. 16.

Figure 11:
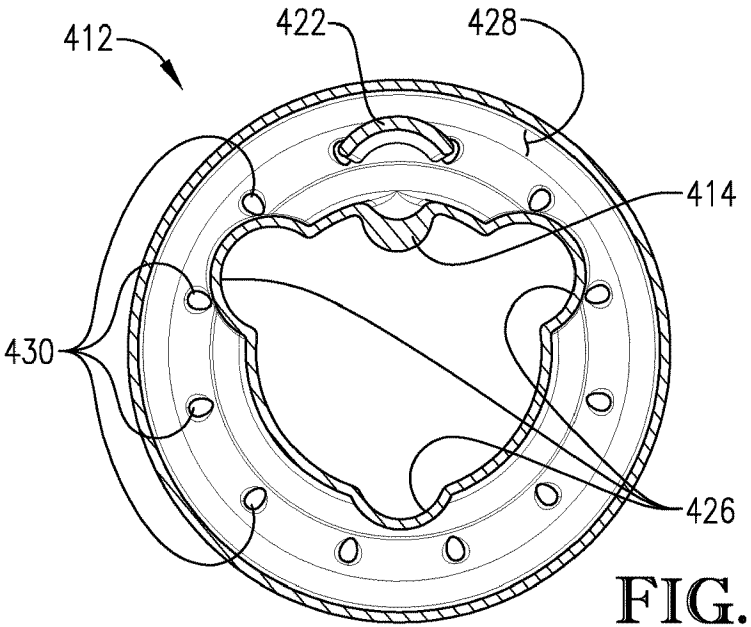
FIG. 11 is another cross-section view of the manifold shown in FIG. 7.

As best seen in FIGS. 10-11, the manifold 412 includes a circular array of fuel injector tips 406, each including a corresponding injector passage 430. More particularly, in the depicted embodiment the manifold 412 includes an array of twelve fuel injector tips 406 and corresponding injector passages 430. The injector passages 430 are in fluid communication with the annular fuel chamber 428, and are open at an end of the fuel injector tips 406 facing the combustion chamber.

In that regard, gaseous fuel or like provided to fuel supply line 408 enters the manifold at the joint 424, encounters the fuel deflector 422 and is thus dispersed about the otherwise open fuel chamber 428. The dispersed fuel then exits the manifold 412 via the fuel injector tips 406, and more particularly the injector passages 430 of the fuel injector tips 406, into the combustion chamber where it is ignited by a spark igniter (not shown), torch 307, or a combustion flame, as will be discussed more fully in connection with FIGS. 17-20. Moreover, and as best seen in FIG. 10, the fuel injector tips 406 are provided at oblique angle with respect to a front face of the tip plate 402. In this regard, fuel exiting the fuel injector tips 406 and the subsequent flame resulting from burning the same is at an oblique angle with respect to the central axis of the combustor A-A. Advantageously, the diffusion flame is thus angled toward the main premix combustion flames, which in turn draw the main combustion flames near the diffusion cartridge assembly 400, anchor the main flames near an inlet of the combustion chamber, and creates a hotter localized flame zone which enhances CO burnout as discussed more fully below in the examples provided. Turbine speed followed by turbine load points are utilized in this example to demonstrate how the diffusion cartridge is utilized to improve turbine performance, however alternative speed points, measured or estimated temperatures at various locations within the turbine, alternative load points, or alternative criteria for mode changes may be substituted within the provided example based on desired operational characteristics.

Placing the fuel manifold 412 proximate the tip plate 402 and in turn igniting gaseous fuel at a tip of the diffusion cartridge assembly 400 provides benefits such as reducing CO emissions at low gas turbine loads and speeds. This and other advantages will be better understood with reference to FIGS. 17-20. FIGS. 17-20 depict a combustor 440 similar to the combustion system 300 depicted in FIG. 1, but which includes the diffusion cartridge assembly 400. In the embodiments shown, the diffusion cartridge assembly 400 is used to provide a relatively hot flame diffusion flame 452—i.e., one that burns hotter than, e.g., a premixed pilot flame 450—which is angled towards a location of the main combustion flames 456, 458. This hot diffusion flame 452 thus helps anchor the main 1 flame 456 and main 2 flame 458 near the tip of the diffusion cartridge assembly 400, and advantageously creates a localized relatively hotter flame area within the premix main 1 and/or main 2 flames which enhances burnout of CO and other exhaust gases that may otherwise escape from the system and ultimately be exhausted to the surrounding environment.

More particularly, FIG. 17 shows a first mode of operating the combustor 440 equipped with the diffusion fuel cartridge assembly 400. In some embodiments, the mode shown in FIG. 17 is used from lightoff of the gas turbine engine up until a speed that is less than a full speed no load (FSNL) condition. For example, in one embodiment the mode shown in FIG. 17 is employed from lightoff and up until approximately 90% of a full speed of the gas turbine engine. In this mode, the pilot flame 450 is ignited, along with the diffusion flame 452. Although for simplicity only one pilot flame 450 is shown, in some embodiments the pilot flame 450 may include both a pilot flame and a pilot tune flame, as previously discussed in connection with FIG. 1.

In order to ignite the diffusion flame 452, gaseous fuel is provided to the manifold 412, which exits the manifold 412 proximate the tip plate 402 via the array of fuel injector tips 406, and which in turn is ignited by a spark igniter, the torch 307, and/or the already burning pilot flame 450. In the depicted embodiment, the pilot flame 450 is a premixed flame (i.e., fuel and air is premixed upstream of the combustion chamber), while diffusion flame 452 is a diffusion flame (i.e., gaseous fuel is injected into the combustion chamber where it mixes with air proximate the flame zone). In this regard, the diffusion flame 452 will generally burn hotter than the premix flame 450. Moreover, while the pilot is generally oriented parallel to the combustor 400's central axis, the diffusion flame 452 is oriented at an oblique angle with respect to the combustor 400's central axis such that the diffusion flame creates a hotter region to affect the relatively colder premixed main fuel circuit region.

FIG. 18 shows a second mode of operating the combustor 440 according to one aspect of the invention. As with the mode shown in FIG. 17, the mode shown in FIG. 18 may be utilized when the gas turbine engine is operating at less than a FSNL condition. For example, in some embodiments the mode shown in FIG. 18 is used when the gas turbine is operating at approximately 90%-95% its full speed. In this mode, premixed fuel is introduced into the main 1 fuel circuit, which results in the unanchored main 1 flame 454. In this context, "unanchored" refers to the flame being axially separated from the diffusion cartridge assembly 400. Because the pilot flame 450 remains ignited in this mode, the flame proximate the tip plate 420 is a mix of the pilot flame and the diffusion flame 452. This results in a cooler and more dispersed flame proximate the tip plate 402 than if, for example, the diffusion only jets were being operated. Thus, the premixed fuel and air of the main 1 circuit travels farther, in the axial direction, before becoming ignited, thus resulting in an unanchored flame.

In contrast, FIG. 19 shows a mode of operation where the main 1 flame is anchored near the diffusion flame cartridge 400, represented by anchored main 1 flame 456. In some embodiments, this mode may be used when the gas turbine engine is operating at a speed less than FSNL to a condition where a substantial load is placed on the gas turbine engine. For example, in some embodiments the mode shown in FIG. 19 is operated from about a 95% speed condition to a point of minimum load during a time of turndown or about a 40 MW load. In this regard, it should be appreciated that this range would include the FSNL condition. In the mode shown in FIG. 19, the main 1 flame 456 is anchored using the diffusion flame 452 emanating from the manifold 412 proximate the tip plate 402. More particularly, the pilot flame 450 is turned off, which in turn concentrates the hot, diffusion flame 452 nearer to the tip plate 402. This hot diffusion flame 452 thus draws the main 1 flame back proximate the diffusion cartridge assembly 400, thus "anchoring" the flame 456 near the diffusion cartridge assembly 400 and/or the inlet of the combustion chamber. Advantageously, anchoring the main 1 flame 456 nearer to the tip plate 402 while creating a relatively hotter flame which reduces CO emissions during periods of turndown.

FIG. 20 shows the combustor 440 being operated in a fourth mode, which may be a period of turndown or ramp up operation. This mode may thus be operated, for example, from about a minimum load during a time of turndown up to a baseload (i.e., a set operating point of highest turbine efficiency given a balance of emissions and power output). In this mode, the main 1 flame 456 remains anchored near the diffusion cartridge 400. Moreover, the main 2 flame 458 is lit and similarly is anchored near the diffusion cartridge 400. The diffusion jets are turned off, thus extinguishing diffusion flame 452. And the pilot circuit is turned on, thus lighting pilot flame 450. However, as shown, the main 1 flame 456 and the main 2 flame 458 remain anchored proximate the inlet of the combustion chamber.

In this regard, all fuel circuits operating in this mode are premixed fuel circuits, thus providing the benefits of reduced NOx emissions achieved from using premixed fuel. Moreover, the main flames—main 1 flame 456 and main 2 flame 458—are anchored near the diffusion cartridge assembly 400. In prior art embodiments, when the main flames were not so anchored, CO would collect near the pilot fuel nozzle 308 during periods of startup and/or turndown and ultimately escape the combustor, leading to unacceptable CO exhaust levels. In embodiments of the instant invention, the anchored main 1 flame 456 and main 2 flame 458 burn this CO that may otherwise escape, thus reducing CO exhaust levels. Thus, the diffusion cartridge assembly 400 can be used to anchor the main, premixed flames of a FlameSheet® combustor or the like, thus reducing CO levels at periods of low load operation, which includes no load operation, such as at turndown and/or startup.

The present invention has been described in relation to particular embodiments, which are intended in all respects to be illustrative rather than restrictive. Alternative embodiments will become apparent to those of ordinary skill in the art to which the present invention pertains without departing from its scope.

From the foregoing, it will be seen that this invention is one well adapted to attain all the ends and objects set forth above, together with other advantages which are obvious and inherent to the system and method. It will be understood that certain features and sub-combinations are of utility and may be employed without reference to other features and sub-combinations. This is contemplated by and within the scope of the claims.

We claim:

1. A combustion system for a gas turbine comprising:

a cylindrical combustion liner having an inlet, an outlet, and a center axis and defining a combustion chamber;

a main mixer located radially outward of the cylindrical combustion liner relative to the center axis, wherein the main mixer is configured to premix fuel and compressed air upstream of the combustion chamber forming a premixed fuel and air mixture, and wherein the main mixer is configured to direct the premixed fuel and air mixture towards one or more main flames within the combustion chamber, the one or more main flames being located circumferentially about the periphery of the combustion chamber; and a diffusion cartridge assembly extending about the center axis of the cylindrical combustion liner and located radially inward of the one or more main flames, the diffusion cartridge assembly configured to inject a gaseous fuel directly into the combustion chamber proximate the inlet of the cylindrical combustion liner; where the diffusion cartridge assembly comprises:

a tip plate including an array of fuel supply openings and a mounting hole radially inward of the array of fuel supply openings;

an end cover;

an outer cylindrical sleeve extending from the tip plate to the end cover and defining an open inner chamber;

a fuel supply line coupled to the end cover and extending within the open inner chamber toward tip plate; and a manifold coupled to an end of the fuel supply line proximate to the tip plate, the manifold including an array of fuel injector tips, each extending through a respective one of the array of fuel supply openings in the tip plate, the manifold further comprising an integral thermally free pin extending into the mounting hole, the thermally free pin including a through hole fluidly connecting the combustion chamber to the inner chamber.

2. The combustion system of claim 1, wherein the fuel supply line is a rigid, non-flexible feed tube affixed to the end cover.

3. The combustion system of claim 1, wherein the manifold is coupled to the fuel supply line at a joint, and wherein the manifold includes an internal fuel deflector proximate to the joint.

4. The combustion system of claim 1, wherein the thermally free pin is non-fixedly received within the mounting hole.

5. The combustion system of claim 4, wherein a diameter of the mounting hole is greater than a diameter of the thermally free pin such that a thermal expansion spacing is formed between the mounting hole and the thermally free pin.

6. The combustion system of claim 1, wherein an array of fuel injector tips are configured to inject the gaseous fuel directly into the combustion chamber proximate an inlet of the cylindrical combustion liner and at an oblique angle with respect to the center axis.

7. A method for operating a combustion system of a gas turbine engine, the method comprising:

providing a cylindrical combustion liner defining a combustion chamber, the cylindrical combustion liner having an inlet, an outlet, and a center axis;

providing a main mixer located radially outward of the cylindrical combustion liner relative to the center axis;

directing into the combustion chamber a main premixed fuel and air mixture, the main premixed fuel and air mixture being formed by premixing fuel and compressed air upstream of the combustion chamber at the main mixer, wherein the main premixed fuel and air mixture is directed into the combustion chamber such that it supports one or more main combustion flames within the combustion chamber, the one or more main combustion flames being located circumferentially about the periphery of the combustion chamber;

providing a diffusion cartridge assembly radially inward of the one or more main combustion flames, the diffusion cartridge assembly extending about the center axis of the cylindrical combustion liner and extending into the combustion chamber and including:

a tip plate including an array of fuel supply openings and a mounting hole radially inward of the array of fuel supply openings;

an end cover;

an outer cylindrical sleeve extending from the tip plate to the end cover and defining an open inner chamber;

a fuel supply line coupled to the end cover and extending within the open inner chamber toward tip plate; and a manifold coupled to an end of the fuel supply line proximate to the tip plate, the manifold including an array of fuel injector tips, each extending through a respective one of the array of fuel supply openings in the tip plate, the manifold further comprising an integral thermally free pin extending into the mounting hole, the thermally free pin including a through hole fluidly connecting the combustion chamber to the inner chamber; and injecting gaseous fuel directly into the combustion chamber using the diffusion cartridge assembly, wherein the gaseous fuel is injected into the combustion chamber proximate the inlet of the cylindrical combustion liner and at an oblique angle with respect to the center axis.

8. The method of claim 7 further comprising injecting a pilot premixed fuel and air mixture into the combustion chamber proximate the diffusion cartridge assembly, the pilot fuel and air mixture being configured to support a pilot flame proximate to the diffusion cartridge assembly.

9. The method of claim 8 further comprising igniting the gaseous fuel to form a diffusion flame and igniting the pilot premixed fuel and air mixture to form the pilot flame.

10. The method of claim 9 further comprising extinguishing the pilot flame while leaving the diffusion flame ignited such that the one or more main combustion flames is drawn towards the diffusion cartridge assembly.

11. The method of claim 10, further comprising, after the one or more main combustion flames is drawn towards the diffusion cartridge assembly, extinguishing the diffusion flame.

* * * * *